United States Patent [19]

Anderson et al.

[11] 4,347,120

[45] Aug. 31, 1982

[54] UPGRADING OF HEAVY HYDROCARBONS

[75] Inventors: Ardis L. Anderson; James R. McConaghy, both of Ponca City, Okla.

[73] Assignee: Conoco Inc., Ponca City, Okla.

[21] Appl. No.: 219,006

[22] Filed: Dec. 22, 1980

[51] Int. Cl.[3] ..... C10B 47/00; C01B 2/14; C10G 13/22

[52] U.S. Cl. ..... 208/50; 208/56; 48/197 R; 48/204; 252/373

[58] Field of Search ..... 208/50, 56, 107, 108; 423/655; 252/375, 377, 373

[56] References Cited

U.S. PATENT DOCUMENTS

| | | | |
|---|---|---|---|
| 2,917,451 | 12/1959 | Leffer | 208/107 |
| 3,617,513 | 11/1971 | Wilson et al. | 208/56 |
| 3,676,517 | 7/1972 | Merrill, Jr. et al. | 208/125 |
| 4,039,426 | 8/1977 | Schutte | 208/50 |
| 4,115,246 | 9/1978 | Sweany | 208/56 |
| 4,155,832 | 5/1979 | Cox et al. | 208/56 |
| 4,178,229 | 12/1979 | McConaghy et al. | 208/56 |
| 4,284,139 | 8/1981 | Sweany | 208/56 |

*Primary Examiner*—Delbert E. Gantz
*Assistant Examiner*—Olik Chaudhuri
*Attorney, Agent, or Firm*—Richard W. Collins

[57] ABSTRACT

Heavy hydrocarbonaceous materials are converted to distillate products and pitch in a hydrogen donor diluent cracking process, and the pitch is utilized as feed to a delayed coker. Green coke is calcined in a vertical shaft kiln, and steam is injected into the bottom of the kiln to produce hydrogen by reaction of steam with coke. The hydrogen is drawn from the kiln and used to hydrogenate recycle donor solvent for the cracking step. High sulfur coke can be desulfurized in the kiln, and distillate products in addition to donor solvent can be hydrotreated using hydrogen from the kiln.

5 Claims, 1 Drawing Figure

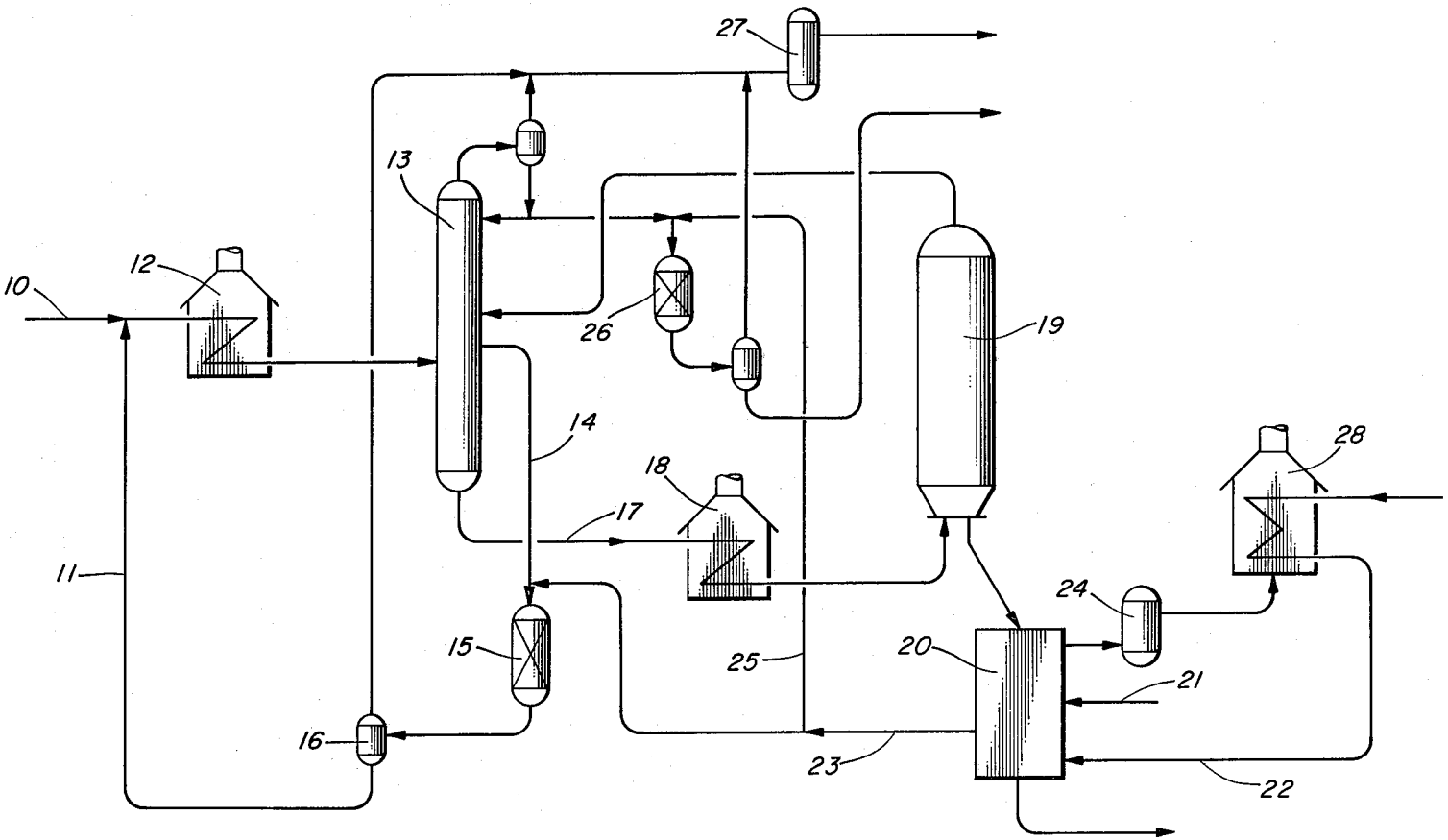
28
22
21
24
19
20
23
27
25
18
26
17
14
15
13
16
12
11
10

UPGRADING OF HEAVY HYDROCARBONS

BACKGROUND OF THE INVENTION

This invention relates to upgrading of heavy hydrocarbonaceous materials, and more particularly to upgrading of materials such as low gravity crude oil, petroleum residual oil, shale oil, tar sand bitumen and coal-derived liquids. The invention is especially useful for upgrading low gravity, high sulfur crude oil.

There are many processes available in the petroleum refining art for upgrading heavy hydrocarbonaceous materials. The prior art process most pertinent to the present invention is described in U.S. Pat. No. 4,178,229. That patent describes treating residual oil by the hydrogen donor diluent cracking method, followed by fractionation of the cracked products to produce gases, distillate streams and pitch. The pitch is then subjected to delayed coking.

A process wherein synthesis gases and calcined coke are produced in a vertical shaft calciner is described in U.S. Pat. No. 3,676,517.

There has been a need for a process of upgrading heavy hydrocarbonaceous materials which is effective, efficient, and does not require an outside source of hydrogen, even when the material being upgraded is a high sulfur material. Such a process is provided by the present invention.

SUMMARY OF THE INVENTION

According to the present invention, heavy liquid hydrocarbonaceous material is subjected to hydrogen donor diluent cracking (HDDC), the effluent from the HDDC is fractionated, and pitch from the fractionator is subjected to delayed coking. The term "pitch" as used herein means a bottom stream from a fractionator used to separate distillates and lighter cracked products from the effluent of an HDDC unit, and the pitch typically contains the heavier effluent components along with some material in the gas oil boiling range.

Green coke from the delayed coking step is calcined in a top fed internally fired moving bed vertical shaft kiln. Steam is injected into the lower part of the kiln to produce a hydrogen-rich stream by the well-known water gas reaction. Part of this gas stream flows up through the calciner, and part of it is withdrawn below the combustion zone and, after treatment to remove carbon dioxide or carbon dioxide and carbon monoxide if desired, used to hydrogenate recycle donor solvent for use in the HDDC step.

In cases where the feedstock is a high sulfur material, the kiln can be operated at desulfurizing conditions to produce a low sulfur coke product, and part of the hydrogen produced in the lower section of the kiln can be used to hydrotreat other product streams from the fractionator.

Accordingly, the process of this invention provides for upgrading a heavy hydrocarbonaceous material such as a low gravity, high sulfur crude oil by the HDDC process and includes the feature of producing the hydrogen required for the HDDC step by reaction of calcined coke produced from the HDDC pitch with steam in a vertical calcining kiln. The products of the process include cracked products and desulfurized coke, and the products are all either low sulfur products or can be hydrotreated by internally generated hydrogen to provide low sulfur products. Hydrogen sulfide can also be recovered and processed by conventional methods to produce elemental sulfur.

BRIEF DESCRIPTION OF THE DRAWING

The drawing is a schematic flow sheet illustrating the preferred embodiment of the invention.

DESCRIPTION OF THE PREFERRED EMBODIMENT

The process of this invention is useful for materials such as tar sand bitumen, petroleum residuum, retorted shale oil, coal-derived liquids and heavy (low gravity) crude oils. It is particularly useful for viscous low gravity high sulfur crudes which have until recently been considered unrecoverable or undesirable for processing. Even high sulfur crudes containing more than ten percent by weight sulfur can be processed successfully by the process of the invention.

The invention as it applies to heavy hydrocarbonaceous materials generally will now be described with reference to the drawing.

Feedstock from line 10 and hydrogenated donor solvent from line 11 are fed to donor cracker 12. The conditions for the HDDC operation are well known, as exemplified by U.S. Pat. Nos. 2,953,513 and 3,238,118. Donor cracker effluent is fractionated in fractionator 13, and recycle donor solvent is drawn off through line 14 and hydrogenated in hydrotreater 15. Hydrogenated solvent from hydrotreater 15 goes through flash separator 16 where gases are removed, and the donor solvent then is recycled to donor cracker 12.

The bottom pitch fraction from fractionator 13 passes through line 17 to coking furnace 18 and then to coke drum 19. The coking is carried out at conventional delayed coking conditions, and overhead vapors from coke drum 19 are returned to fractionator 13.

Green coke from coke drum 19 passes to an internally-fired moving bed vertical shaft kiln 20. Air is injected from line 21 into a combustion zone in kiln 20. Steam from boiler 28 passes through line 22 into the lower part of kiln 20 where it reacts with hot calcined coke according to the reaction $H_2O+C \rightleftarrows H_2+CO$. This is sometimes referred to as the water gas reaction, for which the conditions are well known.

Gas flow in kiln 20 is upward, so that nitrogen from combustion air does not contaminate the water gas reaction products which are withdrawn from line 23 located below the air injection level. The water gas reaction products may be treated in a scrubber (not shown) or other equipment to remove gases other than hydrogen before the hydrogen passes to hydrotreater 15 where it is used to hydrogenate recycle donor solvent. Thus, hydrogen generated in kiln 20 can regenerate the donor solvent for the HDDC unit.

According to a more specific embodiment of the invention, a high sulfur feedstock (above 2 percent by weight sulfur) is fed to donor cracker 12. With a high sulfur feedstock, the green coke from coke drum 19 will contain an unacceptably high sulfur content. By operating kiln 20 at a high temperature (from 1300° to 1500° C.), the sulfur level of the green coke is substantially reduced so that the product coke can be used as a fuel. Sulfur removed from the coke is recovered as hydrogen sulfide in scrubber 24. Part of the hydrogen from kiln 20 is passed through line 25 to hydrotreater 26 where overhead liquids from fractionator 13 are hydrotreated to produce low sulfur products. Gases from various stages of the process are scrubbed in vessel 27 to produce low sulfur gaseous products.

Even very high sulfur crudes (above 8 percent by weight sulfur) having high viscosity and low gravity may be satisfactorily processed in accordance with the invention, producing low sulfur gas, liquid and coke products without the need for purchased hydrogen. This results from the unique combination of the HDDC step with delayed coking and shaft calcining of the coke with internal generation of hydrogen in the calcining kiln. This process is particularly useful where low sulfur liquid products are to be made from high sulfur crude oil in processing plants where reformer generated hydrogen is not vailable.

We claim:

1. A process for upgrading a heavy liquid hydrocarbonaceous material comprising:

(a) subjecting said heavy liquid hydrocarbonaceous material to a hydrogen donor diluent cracking step;

(b) fractionating the products from said cracking step and subjecting the bottoms stream from the fractionation to delayed coking;

(c) passing delayed coke to a top fed internally fired moving bed vertical shaft kiln;

(d) introducing combustion air into said kiln to provide a combustion zone;

(e) maintaining upward gas flow in said kiln and recovering flue gas including nitrogen from the top of the kiln;

(f) introducing steam to the lower portion of said shaft kiln whereby hydrogen is produced by reaction of steam with descending hot coke;

(g) recovering a substantially nitrogen-free hydrogen-rich gas stream from said shaft kiln from a level above the steam injection level and below the combustion air injection level; and (h) utilizing hydrogen from said hydrogen-rich gas stream to hydrogenate hydrogen-depleted recycle donor solvent for use in said donor cracking step.

2. The process of claim 1 wherein said hydrogen-depleted recycle donor solvent is a product of said fractionating step.

3. The process of claim 2 wherein said heavy hydrocarbonaceous material is a high sulfur material, and said shaft kiln is operated at desulfurizing conditions.

4. The process of claim 3 wherein a portion of said hydrogen is utilized to hydrotreat both recycle donor solvent and other distilled liquids from said fractionating step.

5. The process of claim 4 wherein carbon oxides are removed from said hydrogen-rich gas stream prior to utilizing said hydrogen.

* * * * *